United States Patent [19]

See et al.

[11] 4,021,893

[45] May 10, 1977

[54] INSPECTION DEVICE

[75] Inventors: Earl R. See, Conyngham; Gregory E. Slowicki, Mountaintop, both of Pa.

[73] Assignee: Formica Corporation, Cincinnati, Ohio

[22] Filed: Apr. 27, 1976

[21] Appl. No.: 680,656

[52] U.S. Cl. ..... 26/70; 83/520; 242/56 R

[51] Int. Cl.[2] ..... D06H 3/04

[58] Field of Search ..... 26/70; 33/1 BB; 83/52 D; 242/56 R; 356/200, 238

[56] References Cited

UNITED STATES PATENTS

| | | | |
|---|---|---|---|
| 2,834,558 | 5/1958 | Halpin | 26/70 UX |
| 3,207,021 | 9/1965 | Bradley | 83/520 |
| 3,266,359 | 8/1966 | Homsher | 26/70 X |
| 3,712,744 | 1/1973 | Nelson | 26/70 X |

FOREIGN PATENTS OR APPLICATIONS

| | | | |
|---|---|---|---|
| 107,179 | 10/1924 | Switzerland | 26/70 |
| 464,382 | 4/1937 | United Kingdom | 26/70 |
| 261,359 | 11/1970 | U.S.S.R. | 26/70 |

*Primary Examiner*—Robert R. Mackey
*Attorney, Agent, or Firm*—Frank M. Van Riet

[57] ABSTRACT

A table-like inspection device utilized to inspect rolls of newly manufactured wall covering for design alignment, visual defects and pinholes.

5 Claims, 3 Drawing Figures

INSPECTION DEVICE

BACKGROUND OF THE INVENTION

In the manufacture of rolled goods, i.e. goods which are manufactured and are removed from their final production station in a rolled-up condition, such as fabrics, wall coverings, paper etc., it is necessary to somehow inspect these goods for flaws such as misalignment of design, design defects, pinholes etc. This is especially true in the wall covering industry wherein a serious design deformity can run continuously through a series of product rolls before detection.

While this problem of product quality has been recognized for many years, a rapid quality control mechanism has not heretofore been available. Prior to our invention, inspection of rolls of wall covering, which usually comprise from 25–35 feet of material, was accomplished by unrolling the wall covering manually atop a 40-foot table, inspecting the unrolled material with the naked eye by walking alongside the table and then manually rerolling the material. Any defects and flaws which were discovered were removed by cutting the material before it was rerolled.

SUMMARY OF THE INVENTION

We have now discovered an inspection device which enables an inspector to examine long lengths of rolled material for surface flaws, printed design errors etc. without having to walk the entire length of the unrolled material. Our device enables the inspector to examine more material in a given length of time and because it obviates the need for a long 40-foot table, results in a savings of valuable floor space. Additionally, flaws imparted to the material during its manufacture which were previously undetectable, such as pinholes, are more easily discovered using our novel device.

DESCRIPTION OF THE INVENTION INCLUDING PREFERRED EMBODIMENTS

As mentioned briefly above, we have discovered a novel inspection device which may be utilized to detect defects in rolled goods. The device comprises a. a table-like apparatus having form legs and a horizontal platform attached thereto, the platform having a front and back edge;

b. trough means attached to one end of said device adjacent said platform;

c. roller means pivotally affixed at one end thereof to the back edge of and extending across to said front edge of, said platform;

d. a transparent, gridded sheet pivotally affixed at one side thereof to said back edge of and extending across to said front edge of, said platform;

e. cutting means pivotally affixed to said back edge of said platform and having a cutting edge adapted to slide across said platform to said front edge thereof;

f. lighting means positioned below the horizontal surface of and adapted to emit light through, said platform;

g. roll-up means attached to the end of said platform opposite the end thereof to which is attached said trough means;

h. means for actuating said roller means;

i. means for actuating said roll-up means 3 and j. means for pivotally raising and lowering said roller means, said sheet and said cutting means.

Figure 1:
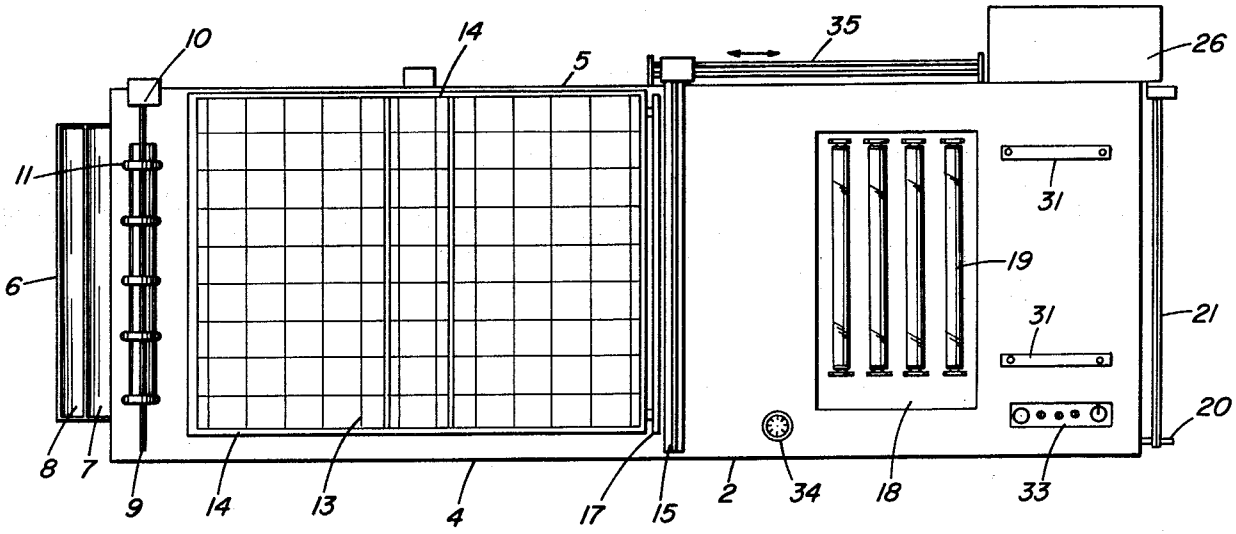
FIG. 1 is a top view of the inspection device of the instant invention.
Figure 2:
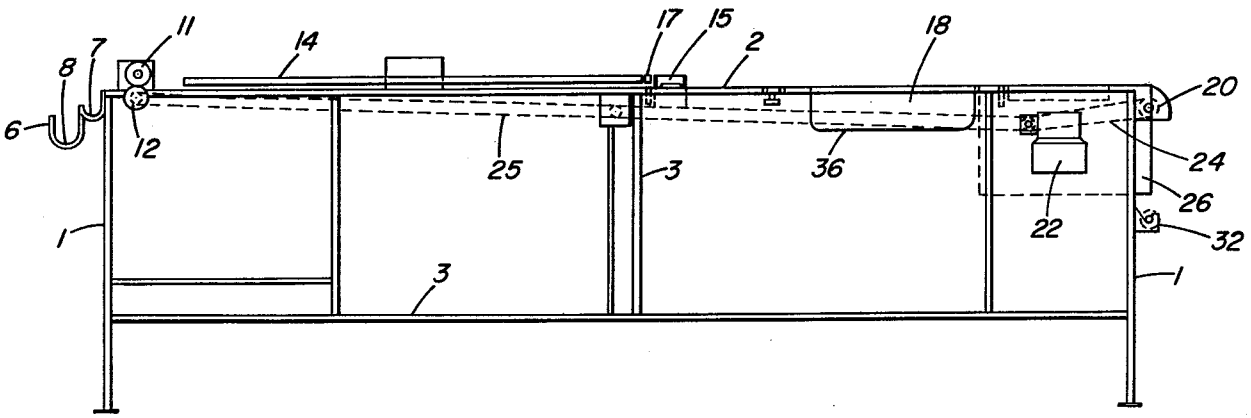
FIG. 2 is a front view of the inspection device of the instant invention.

With reference to said drawings, particularly FIG. 2, the instant device is comprised of legs 1, four of which are positioned, one in each corner of platform 2. Braces 3 strengthen the device and hold it steady. Platform 2 is preferably rectangular in shape and possesses a front edge 4 and a back edge 5. Trough means 6 is attached to one of the ends of the device adjacent to platform 2 and contains a retainer section 7 and an over-flow section 8 therein.

Roller means 9 is pivotly affixed at end 10 thereof to back edge 5 of platform 2 and extends across the platform to the front edge 4 thereof. Means 9 comprises a first roller or set of rollers or wheels 11 positioned atop said platform 2 and a second roller or set of drive rollers or wheels 12 positioned below said platform. The two rollers 11 and 12 contact each other at about the horizontal plane of platform 2.

A transparent sheet 13, preferably rigidized by frame 14, is gridded, pivotly affixed at edge 14 thereof to the back edge 5 of platform 2 and extends across the platform to its front edge 4.

Figure 3:
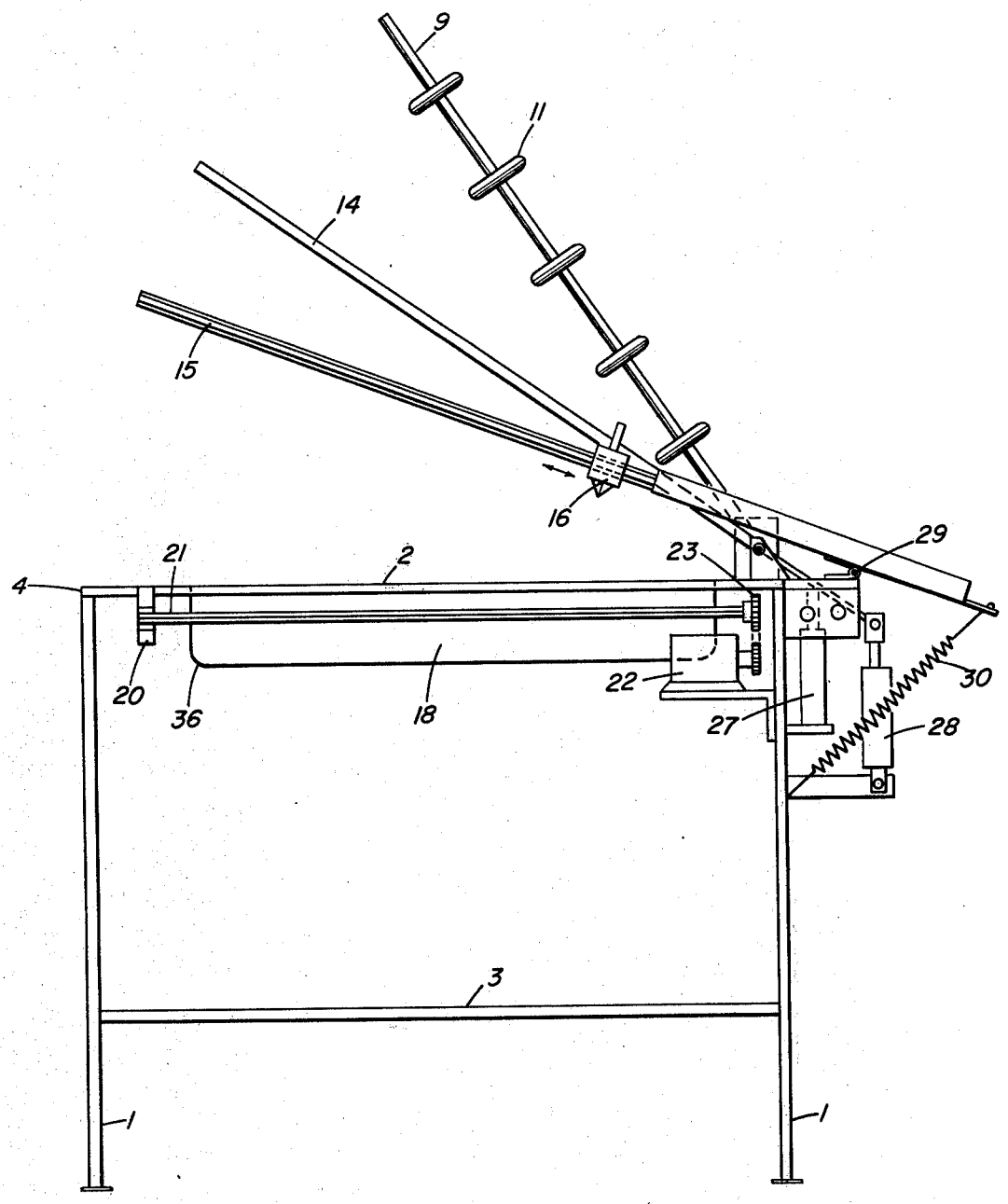
FIG. 3 is an end view of the inspection device of the instant invention with the roller, grid screen and cutting bar in raised position.

Cutting means 15 is also pivotly affixed at one of its ends to rails 35 on the back edge 5 of platform 2 by hinge 29, FIG. 3, and also extends across the platform to its front edge 4. A cutting edge 16 is slideably mounted onto means 15 and traverses the length of means 15 in the direction shown by the arrow of FIG. 3. Means 15 can also move laterally along rails 35. Static eliminator 17 is positioned between the sheet 13 and cutting means 15 and eliminates static from material which flows thereunder across the length of the platform, if desired.

The detection of pinholes or weak spots in the material undergoing inspection on our device is accomplished by the utilization of lighting means 18 which, preferably, is composed of a bank of lights 19 positioned below the horizontal surface of the platform 2 and emitting light therethrough, such as by through a sheet of transparent material, not shown, set into the platform. The lighting means is preferably encased within confines of box 36 to prevent damage thereto.

Roll-up means 20 comprises slotted rod 21 and is positioned at the end of platform 2 opposite the end thereof to which is attached said trough means 6. Roll-up means 20 is actuated by means 22 which comprises a motor and driving mechanism such as gears 23 and chain 24. Means 22 is further attached to roller means 9 by a second chain means 25 which thereby drives roller means 9. Power is supplied to the device via electrical power box 26, not shown in FIG. 3.

Roller means 9 and gridded sheet or panel means 13 are actuated by air cylinder means 27 and 28, respectively, FIG. 3, the air source to which is not shown. Cutting means 15 is manually raised and lowered and is held in proper position by tension spring 30. Cutting edge 16 is also manually operated by the inspector by merely sliding it along means 15 as discussed above.

Aligning means 31 comprises two guides positioned atop platform 2 for keeping the material traversing the length of platform 2 in proper alignment on roll-up means 20. Tape dispenser 32 is a retainer of tape, pieces of which may be torn off a roll and used to mark the flaws and defects in the material as it is being inspected by the operator.

In operation, a roll of material such as a common double roll of commercial wall covering is placed into the retainer section 7 of trough 6. At this time, the apparatus is in a position as shown in FIG. 3, i.e. roller means 9, gridded sheet 13 and cutting means 15 are all in an upraised position. The material is hand-threaded across platform 2, between aligning means 31 and is attached to roll-up means 20 by insertng it through the slot in rod 21. The appropriate switch on panel 33 is turned on to activate roll-up means 20 by engaging gears 23. The motor 22 causes the gears to start the roll-up means moving via chain 24, which, in turn, causes the material to being to pass across the surface of platform 2. A second switch on panel 33 is then turned on and the gridded sheet 13 is caused to lay over the moving material so as to enable the operator to inspect the material for squareness and design continuity. The lights are also turned on via a switch on panel 33 so as to enable the operator to detect pinoles and flaws which may be present in the material by the passage of light therethrough.

When a flaw is detected, the drive motor 22 is stopped and the gears 23 are disengaged. Grid panel 13 is retracted, all via switches on panel 33. The motor 22 is then reversed and a switch on panel 33 is turned on to lower roller means 9 onto the material and cause roller 11 to thereby be pressed against drive roller 12. This causes the flow of the material to be reversed and deposits that material to be collected in over-flow section 8 of trough 6. The reverse motion is then stopped, and roller means 9 is retracted. Cutting means 15 is then engaged by the operator by sliding it across rails 35 to the proper position. Cutting edge 16 is then used to cut the flaw from the inspected roll of material. Cutting means 15 is then retracted, the material removed from rod 21, the remaining material reattached to rod 21 and forward movement restarted as described above. Material speed can be controlled via control 34. Tape from dispenser 32 can be stuck to an edge of the material to mark a questionable defect therein:

We claim:

1. An inspection device comprising a. four legs and a horizontal platform having a front and back edge, b. trough means attached to one end of said device adjacent said platform, c. roller means pivotly affixed at one end thereof to said back edge of and extending across to said front edge of said platform, d. a transparent gridded sheet pivotly affixed at one side thereof to said back edge of and extending across to said front edge of said platform, e. cutting means pivotly affixed to said back edge of said platform having a cutting edge adapted to slide across said platform to said front edge thereof, f. lighting means positioned below the horizontal surface of and adapted to emit light through said platform, g. roll-up means attached to the end of said platform opposite the end thereof to which is attached said trough means, h. means for actuating said roller means, i. means for actuating said roll-up means, j. means for pivotly raising and lowering said roller means, and k. means for pivotly raising and lowering said sheet.

2. An inspection device according to claim 1 wherein said trough means has an overflow section affixed to the outer edge thereof.

3. An inspection device according to claim 1 wherein said roller means comprises a first roller positioned atop said platform and a second roller positioned below said platform, the two rollers contacting with one another at the horizontal plane of said platform.

4. An inspection device according to claim 1 including l. aligning means positioned atop said platform.

5. An inspection device according to claim 1 wherein said lighting means comprises a bank of lights positioned below a transparent section of material positioned in the surface of said platform.

* * * * *